US008004508B2

(12) United States Patent
Kang et al.

(10) Patent No.: US 8,004,508 B2
(45) Date of Patent: Aug. 23, 2011

(54) FIXED CONTROL DATA GENERATION CIRCUIT AND DISPLAY DEVICE DRIVING IC HAVING THE SAME

(75) Inventors: Won-sik Kang, Seoul (KR); Jae-goo Lee, Gyeonggi-do (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 1043 days.

(21) Appl. No.: 11/838,386

(22) Filed: Aug. 14, 2007

(65) Prior Publication Data

US 2008/0165113 A1 Jul. 10, 2008

(30) Foreign Application Priority Data

Jan. 4, 2007 (KR) ..... 10-2007-0001182

(51) Int. Cl.
*G09G 5/00* (2006.01)

(52) U.S. Cl. ..... 345/204; 345/98

(58) Field of Classification Search ..... 345/87–104, 345/204

See application file for complete search history.

(56) References Cited

U.S. PATENT DOCUMENTS 4,656,596 A * 4/1987 Thaden et al. ..... 345/28
5,490,107 A * 2/1996 Akaogi et al. ..... 365/185.22
2007/0013725 A1* 1/2007 Burkhardt et al. ..... 345/690

FOREIGN PATENT DOCUMENTS

KR 10-1999-0012409 2/1999
KR 10-2001-0004538 A 1/2001
KR 10-2005-0122501 A 12/2005

* cited by examiner

*Primary Examiner* — Jimmy H Nguyen
(74) *Attorney, Agent, or Firm* — Myers Bigel Sibley & Sajovec

(57) ABSTRACT

Provided are a fixed control data generation circuit and a display device driving circuit having the same, which can efficiently implement a metal layout for generating fixed control data. The display device driving circuit includes a fixed control data generation unit including a plurality of logic devices having at least one rows and at least one columns, a register receiving and storing fixed control data, and a logic circuit receiving a signal provided from the register as control data and generating a signal for driving a display device by performing a logic operation using the control data. Each of the plurality of logic devices is connected to one of a first voltage and a second voltage through a metal line and provides the connected voltage as the fixed control data to outside.

14 Claims, 7 Drawing Sheets

FIXED CONTROL DATA GENERATION CIRCUIT AND DISPLAY DEVICE DRIVING IC HAVING THE SAME

REFERENCE TO PRIORITY APPLICATION

This application claims priority from Korean Patent Application No. 10-2007-0001182, filed Jan. 4, 2007, the disclosure of which is hereby incorporated herein by reference.

FIELD OF THE INVENTION

The present invention relates to integrated circuit devices, and more particularly, to display device driving circuits and methods of operating same.

BACKGROUND OF THE INVENTION

A liquid crystal device (LCD) is a type of display device that is widely used in notebook computers and monitors. The LCD includes a panel for implementing an image, and the panel includes a plurality of pixels. The plurality of pixels are formed at an intersecting area between a plurality of scan lines for transmitting gate selection signals and a plurality of data lines for transmitting color data (i.e., gradation data). A conventional driving circuit for driving a display device such as the LCD will be described with reference to FIG. 1. FIG. 1 is a block diagram of a portion of a conventional driving circuit for driving a display device. Referring to FIG. 1, the driving circuit 10 includes a control register 11 and a logic circuit 12 in addition to a driver (not shown) for driving a panel and a memory (not shown). The control register 11 stores control data HOST_DATA provided from a host. The logic circuit 12 receives the control data HOST_DATA from the control register 11 and performs a logic operation using the control data HOST_DATA. The display device operates in a predetermined way according to a signal corresponding to the operation result, which is generated by the logic circuit 12.

The logic circuit 12 also receives a plurality of control signals in addition to bit values of the control data HOST_DATA output from the control register 11 so as to perform a predetermined logic operation and generates various signals for driving the display device. Although data for setting the control data HOST_DATA stored in the control register 11 is provided from the host in FIG. 1, another portion of the control register 11 may also store control data provided from a storage device such as erasable programmable read only memory (EPROM), electrically erasable programmable read only memory (EEPROM), or dynamic random access memory (DRAM). Since the conventional driving circuit illustrated in FIG. 1 is associated with image implementation, it may cause an abnormal image in a display panel if it malfunctions. For example, an error may occur during driving of the display device due to external causes such as electrostatic discharge (ESD).

FIG. 2 illustrates a case where data stored in the control register 11 is changed by ESD attack. The control register 11 may include a plurality of flip-flops one of which is indicated as 11_1 in FIG. 2. The flip-flop 11_1 stores the control data HOST_DATA provided from the host and outputs the stored control data HOST_DATA to the logic circuit 12 in response to a predetermined clock signal CLK. However, the driving circuit for driving the display device such as the LCD is likely to be exposed to external noise such as ESD during a display operation. Bit values of the control data HOST_DATA stored in the flip-flop 11_1 (e.g., a bit value for setting a common voltage and a bit value for gamma correction) may be changed. For this reason, the logic circuit 12 may malfunction, causing abnormal display in an LCD screen.

In particular, when the control data HOST_DATA is provided to the logic circuit 12 in order to set the display quality property of the display device, the control data HOST_DATA conventionally has fixed data using a metal layer so is not to be changed by an external cause such as ESD attack. A structure for providing fixed control data is as illustrated in FIG. 3. In particular, FIG. 3 is a block diagram of a logic circuit that provides fixed control data according to the prior art. Referring to FIG. 3, the logic circuit includes a flip-flop 21 into which control data HOST_DATA provided from a host and a predetermined clock signal CLK are input and a multiplexer 22 into which fixed control data FIX_DATA provided using a metal layer and an output of the flip-flop 21 are input and which outputs one of the fixed control data FIX_DATA and the output of the flip-flop 21. Thus, control data Ctr_DATA is generated by the logic circuit and a display device driving circuit may include a plurality of logic circuits illustrated in FIG. 3 in order to provide a plurality of control data to the logic circuit 12.

To test the display quality property of the display device, control data in various forms are provided to a plurality of flip-flops from the host. Once bit values of control data capable of optimizing the display quality property according to a test result, the fixed control data FIX_DATA having bit values corresponding to the set bit values is provided to the multiplexer 22. The fixed control data FIX_DATA may be provided using a metal layer connected to a power supply voltage VDD or a ground voltage VSS. For example, a metal line connected to the power supply voltage VDD may be connected to the multiplexer 22 in order to provide the fixed control data FIX_DATA having a bit value of '1', and a metal line connected to the ground voltage VSS may be connected to the multiplexer 22 in order to provide the fixed control data FIX_DATA having a bit value of '0'. When the display device is driven, the multiplexer 22 provides the fixed control data FIX_DATA to the logic circuit 12 as the control data Ctr_DATA for setting the display quality property of the display device.

FIG. 4 illustrates a metal layout of a display device driving circuit having the logic circuit illustrated in FIG. 3. To provide the fixed control data Fix_DATA having the bit values corresponding to the test result, a metal layout is implemented in the form as illustrated in FIG. 4. In particular, to provide the fixed control data Fix_DATA of a logic high or low level, a plurality of metal lines selectively connected to a power supply voltage (VDD) line or a ground voltage (VSS) line are required and each of the metal lines provides single fixed control data Fix_DATA.

In general, thousands of bits of control data are required to set the display quality properties of the display device. However, when fixed control data is used to prevent control data from being changed by an external cause, a large amount of control data is required, thereby increasing the number of metal lines for providing the fixed control data. In other words, when the fixed control data is generated using a metal line as illustrated in FIG. 4, a layout for implementing the metal line by become inefficient.

SUMMARY OF THE INVENTION

Embodiments of the present invention include a display device driving circuit having a control data generation unit therein. This generation unit is configured to generate a fixed stream of control data in response to at least one row address and at least one column address. According to some of these embodiments, the generation unit includes a two-dimensional array of logic devices. Each of these logic devices is electrically coupled to a corresponding row line, a corresponding column line and a corresponding one of a pair of signal lines held at unequal voltage levels (e.g., logic 0 and logic 1). This pair of signal lines may include a power supply voltage line (e.g., Vdd) and a ground voltage line (e.g., Vss). According to alternative embodiments of the invention, the logic devices within the two-dimensional array may be CMOS transmission gates having a first current carrying terminal electrically connected to a corresponding column line, a second current carrying terminal electrically connected to a corresponding one of the pair of signal lines and a first control terminal electrically connected to a corresponding row line. This electrical connection between the second current carrying terminal and the corresponding one of the pair of signal lines may be provided by a fuse element.

According to further aspects of these embodiments, a row decoder and a column decoder are provided. The row decoder may be electrically connected to the two-dimensional array of logic devices by a plurality of the row lines and the column decoder may be electrically connected to the two-dimensional array of logic devices by a plurality of the column lines. These embodiments of the present invention may also include a control data selection circuit configured to receive the fixed stream of control data from the generation unit during, a control data loading operation. The control data selection circuit includes a multiplexer having a first input terminal electrically coupled to a serial data output of the generation unit. A register unit may also be included. The register unit is electrically coupled to an output of the control data selection circuit.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

The present invention will now be described more fully hereinafter with reference to the accompanying drawings, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 5:
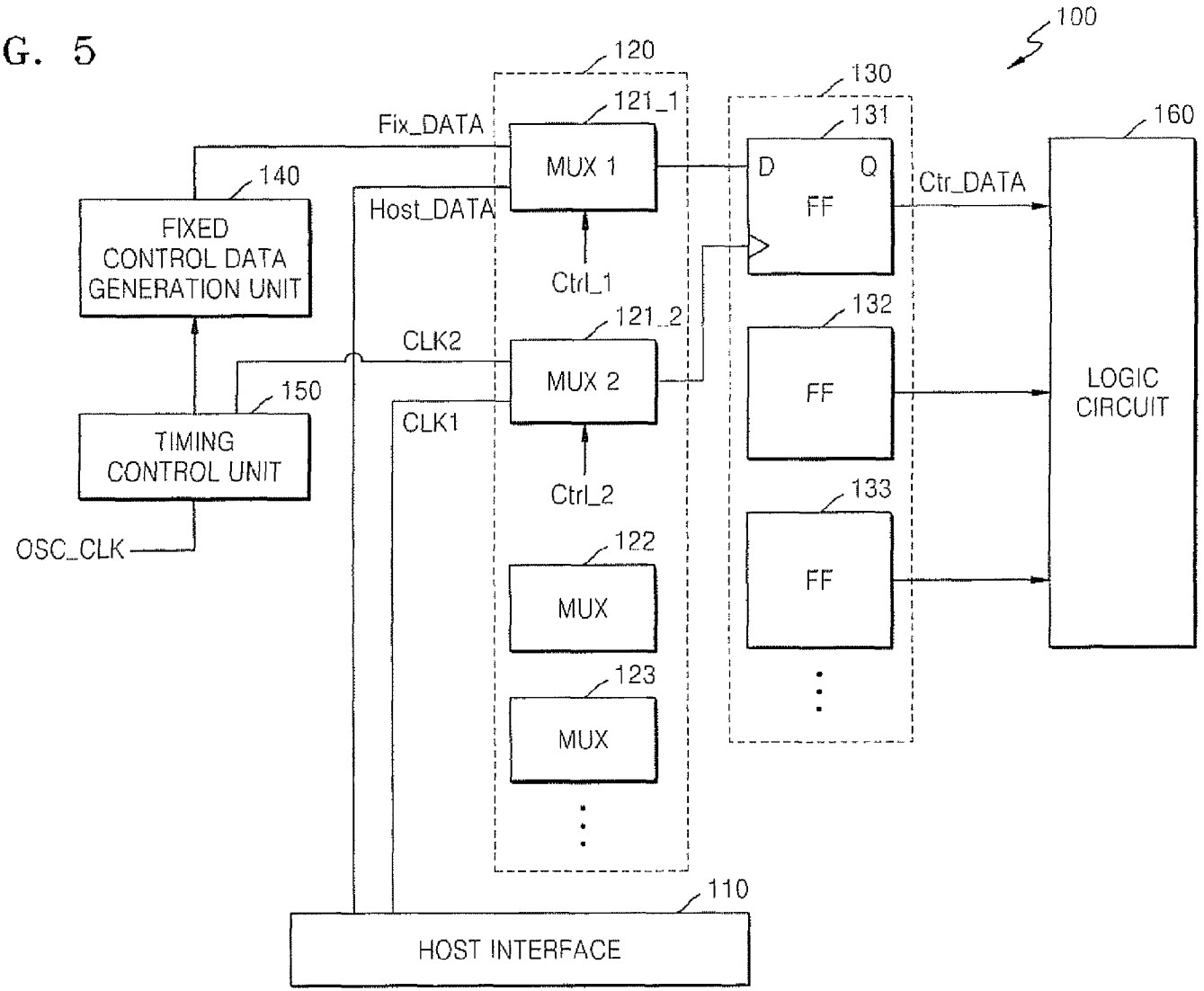
FIG. 5 is a block diagram of a portion of a display device driving circuit according to a first exemplary embodiment of the present invention.

FIG. 5 is a block diagram of a portion of a display device driving circuit 100 according to a first exemplary embodiment of the present invention. Referring to FIG. 5, the display device driving circuit 100 includes a host interface 110 that transmits a signal to or receives a signal from a host (for example, a central processing unit (CPU)), a register unit 130 unit that stores control data used to set the operation of a display device (not shown), a fixed control data generation unit 140 that generates and provides fixed control data to prevent control data from being changed by external attack such as electrostatic discharge (ESD), and a logic circuit 160 that generates various signals for driving the display device by performing a predetermined logic operation using the control data provided from the register unit 130.

The display device driving circuit 100 may further include a timing control unit 150 that generates an address signal for controlling the operation of the fixed control data generation unit 140 and generates a control clock signal for controlling the output of the control data stored in the register unit 130. The display device driving circuit 100 may also include a control data selection unit 120 connected between the fixed control data generation unit 140 and the register unit 130. The control data selection unit 120 receives fixed control data Fix_DATA output from the fixed control data generation unit 140 and host control data Host_DATA provided from the host and outputs one of the fixed control data Fix_DATA and the host control data Host_DATA to the register unit 130.

The control data selection unit 120 includes a plurality of multiplexers. Among the plurality of multiplexers, a first multiplexer 121_1 receives the fixed control data Fix_DATA and the host control data Host_DATA and Outputs one of them to the register unit 130. Among the plurality of multiplexers, a second multiplexer 121_2 receives a control clock signal CLK2 provided from the timing control unit 150 and a host clock signal CLK1 provided from the host and outputs one of them to the register unit 130. The register unit 130 may include at least one of the flip-flops 131 through 133. Each of the flip-flops 131 through 133 receives control data and clock signal from the control data selection unit 120. For example, control data output from the first multiplexer 121_1 is input to an input terminal of the flip-flop 131 and a clock signal output from the second multiplexer 121_2 is input to a clock terminal of the flip-flop 131. The fixed control data generation unit 140 includes a plurality of logic devices, each of which is electrically connected to one of a power supply voltage VDD and a ground voltage VSS through a metal line. Thus, each of the logic devices provides the power supply voltage VDD or the ground voltage VSS as fixed control data. In particular, the logic devices are arranged in a matrix form having at least one row and at least one column.

As illustrated in FIG. 5, the control data selection unit 120 may include a plurality of multiplexers and the register unit 130 may include a plurality of flip-flops. If the fixed control data generation unit 140 outputs fixed control data Fix_DATA of 8 bits corresponding to a single address (i.e., each word is 8 bits), the control data selection unit 120 may include 8 multiplexers for receiving the fixed control data Fix_DATA and 8 multiplexers for receiving the control clock signal CLK2. Thus, if 1000 fixed control bits of data are sequentially output from the fixed control data generation unit 140 so as to be provided to the logic circuit 160, 1000 flip-flops may be included in the register unit 130. Although not shown in FIG. 5, by controlling the signal output paths of the multiplexers within the control data selection unit 120, each of the multiplexers sequentially outputs signals to the plurality of flip-flops.

An oscillation signal OSC_CLK is provided from an oscillator (not shown) that is activated during a predetermined period after the display device is reset. Control signals Ctrl_1 and Ctrl_2 are used to control the first multiplexer 121_1 and the second multiplexer 121_2.

Hereinafter, the operation of the display device driving circuit 100 according to the first exemplary embodiment of the present invention will be described. In a test stage during manufacturing of the display device driving circuit 100, the characteristics of the display device are tested using the host control data Host_DATA and the host clock signal CLK1 transmitted by the host interface 110. For example, the host may provide 1000 bits of host control data Host_DATA in various forms for gamma correction of the display device in the test stage. The host control data Host_DATA and the host clock signal CLK1 are input to the control data selection unit 120.

For example, as shown FIG. 5, the host control data Host_DATA, which is input to the first multiplexer 121_1, and the host clock signal CLK1, which is input to the second multiplexer 121_2, are output to the flip-flop 131 included in the register unit 130 in response to the control signals Ctrl_1 and Ctrl_2. The host control data Host_DATA stored in the flip-flop 131 is provided as control data Ctr_DATA to the logic circuit 160. Similarly, each of the multiplexers 122 and 123 may include two multiplexers, and the host control data Host_DATA and the host clock signal CLK1 may be input to the each of these multiplexers 122 and 123.

1000 Bits of control data for setting the operation of the display device (e.g. capable of optimizing the display quality property of the display device), are determined according to the test result. Once the bit values are determined, the operation setting is made so that the fixed control data Fix_DATA can have bit values corresponding to the determined bit values using a metal layer connected to a power supply voltage or ground voltage.

The timing control unit 150 generates an address signal for controlling the output operation of the fixed control data generation unit 140 using the oscillation signal OSC_CLK. The timing control unit 150 also generates the control clock signal CLK2 for controlling the output of the fixed control data Fix_DATA stored in the register unit 130.

The fixed control data Fix_DATA provided by the fixed control data generation unit 140 is input to the first multiplexer 121_1 and the control clock signal CLK2 provided by the timing control unit 150 is input to the second multiplexer 121_2. The fixed control data Fix_DATA input to the first multiplexer 121_1 and the control clock signal CLK2 input to the second multiplexer 121_2 are output to the flip-flop 131 in response to the control signals Ctrl_1 and Ctrl_2. The fixed control data Fix_DATA stored in the flip-flop 130 is provided as control data Ctr_DATA to the logic circuit 160.

As mentioned above, the fixed control data generation unit 140 may include a plurality of logic devices having at least one row and at least one column. Each of the logic devices is electrically connected to a line for transmitting the power supply voltage VDD (i.e., the power supply voltage VDD line), or a line for transmitting the around voltage VSS (i.e., the ground voltage VSS line). Each of the logic devices is controlled by an address signal provided from the timing control unit 150 and outputs the power supply voltage VDD or the ground voltage VSS as fixed control data to the control data selection unit 120. Hereinafter, the fixed control data generation unit 140 will be described in detail with reference to FIG. 6.

Figure 6:
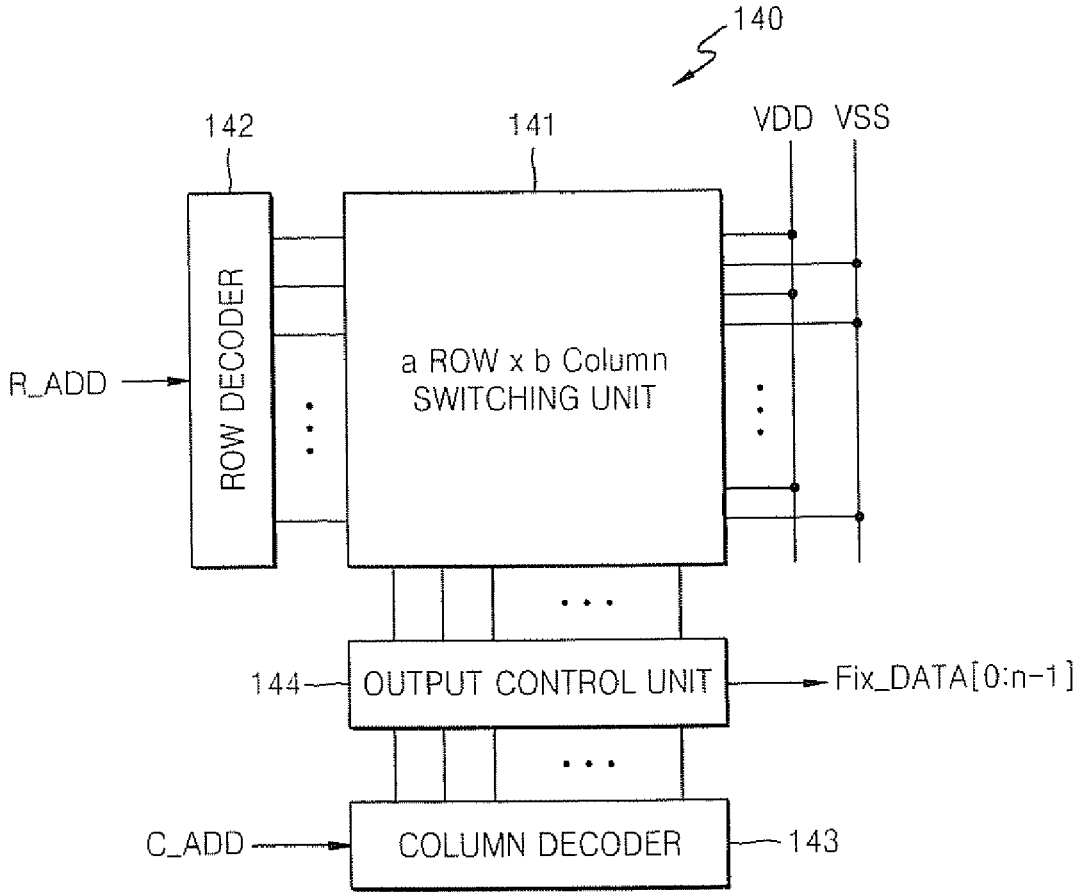
FIG. 6 is a detailed block diagram of a fixed control data generation unit illustrated in FIG. 5.

FIG. 6 is a detailed block diagram of the fixed control data generation unit 140 illustrated in FIG. 5. Referring to FIG. 6, the fixed control data generation unit 140 includes a plurality of logic devices 141 having a plurality of rows (a) and a plurality of column (b). As illustrated in FIG. 6, the plurality of logic devices 141 may be implemented as switching devices.

The fixed control data generation unit 140 may further include a row decoder 142 for driving rows of the switching devices and a column decoder 143 for driving columns of the switching devices. The row decoder 142 decodes a row address signal R_ADD provided from the timing control unit 150 and the column decoder 143 decodes a column address signal C_ADD provided from the timing control unit 150. The fixed control data generation unit 140 may further include an output control unit 144 that is connected between the switching devices and the column decoder 143 and controls the output of fixed control data Fix_DATA [0:n−1].

To generate fixed control data having predetermined bit values according to the test result, each of the plurality of switching devices is selectively connected to the power supply voltage VDD line or the ground voltage VSS line through a metal layer. Each of the switching devices provides the electrically connected power supply voltage VDD or ground voltage VSS as fixed control data to the output control unit 144 in response to a decoded row address signal output from the row decoder 142. The output control unit 144 selectively outputs fixed control data in response to a decoded column address signal output from the column decoder 143. The fixed control data Fix_DATA [0:n−1] Output from the output control unit 144 is input to the control data selection unit 120 illustrated in FIG. 5.

Figure 7:
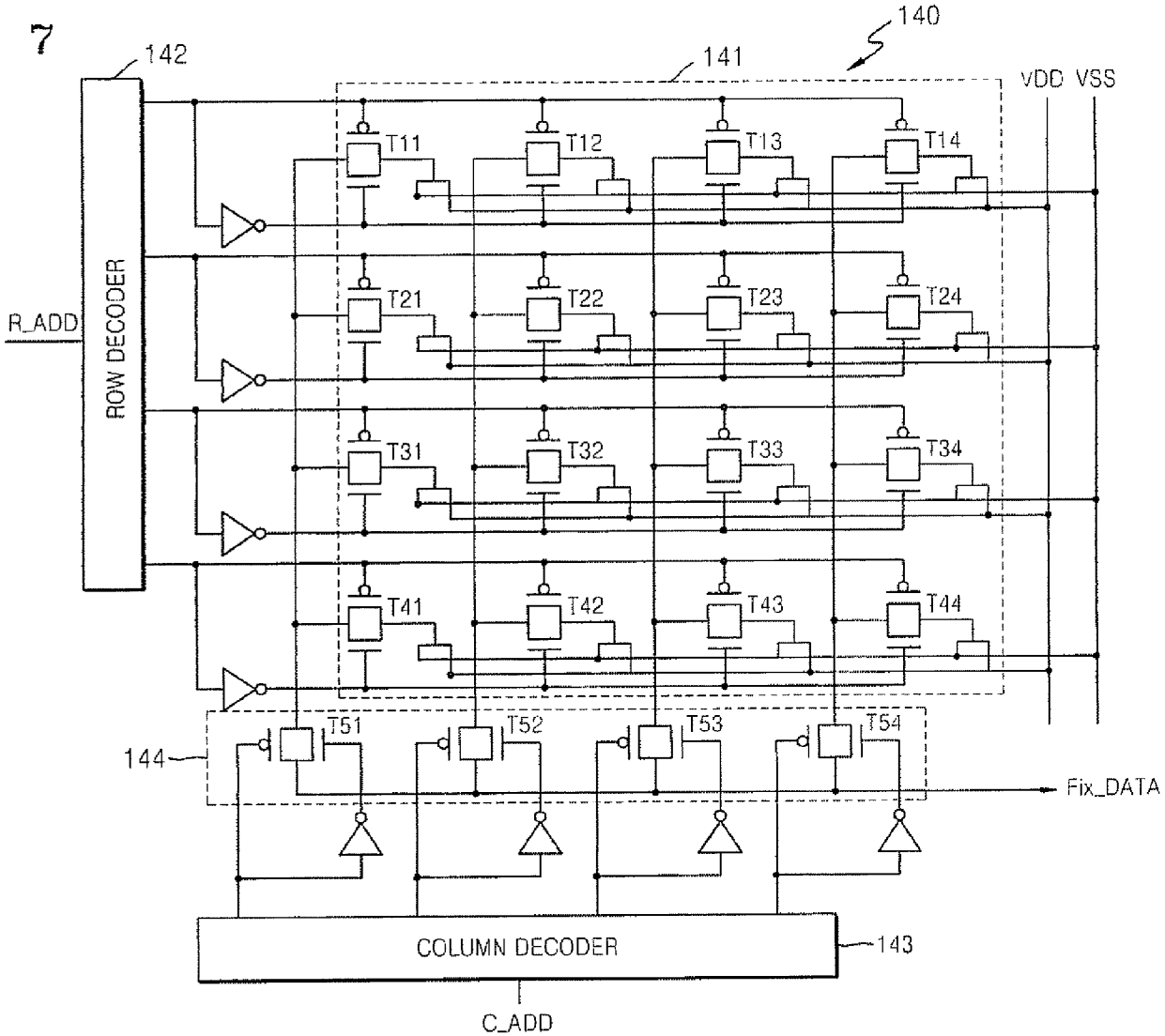
FIG. 7 is a detailed circuit diagram of the fixed control data generation unit illustrated in FIG. 5.

FIG. 7 is a detailed circuit diagram of the fixed control data generation unit 140 illustrated in FIGS. 5-6. Referring to FIG. 7, the fixed control data generation unit 140 includes a plurality of switching devices 141 and T11 through T44 in a matrix form, the row decoder 142, the column decoder 143, and the output control unit 144.

A first electrode of each of the plurality of switching devices T11 through T44 is connected to the power supply voltage VDD line or the ground voltage VSS line through a metal layer. For example, the switching unit T11 may be connected to the ground voltage VSS, the switching unit T12 may be connected to the power supply voltage VDD, the switching unit T13 may be connected to the ground voltage VSS, and the switching unit T14 may be connected to the power supply voltage VDD.

A control electrode of each of the plurality of switching devices T11 through T44 is connected to a decoded row address signal output from the row decoder 142. Thus, each of the switching devices T11 through T44 controls transmission of a voltage connected to the first electrode in response to the decoded row address signal. A second electrode of each of the plurality of switching devices T11 through T44 is connected to the output control unit 144. The output control unit 144 includes a plurality of switching devices T51 through T54 gated in response to the decoded column address signal.

The plurality of rows and the plurality of columns may be sequentially activated. For example, upon activation of the first row, fixed control data is provided from the switching devices T11 through T14 to the output control unit 144. The switching devices T51 through T54 included in the output control unit 144 sequentially output bits of the fixed control data one-by-one in response to the sequentially activated column address signals. After activation of the second row, fixed control data is provided from the switching devices T21 through T24. The switching devices T21 trough T24 sequentially output bits of the fixed control data one-by-one in response to the sequentially activated column address signals.

Figure 1:
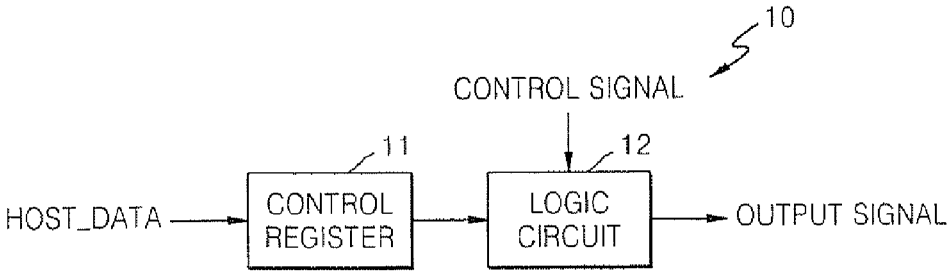
FIG. 1 (PRIOR ART)
FIG. 1 is a block diagram of a conventional display device driving circuit.
Figure 2:
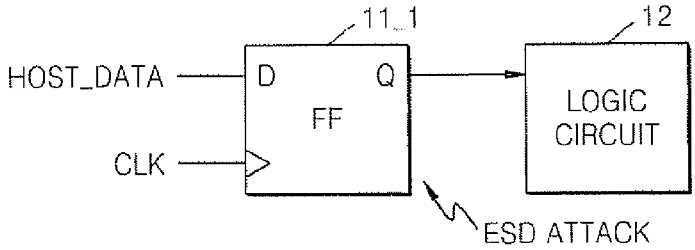
FIG. 2 (PRIOR ART)
FIG. 2 illustrates a case where data stored in a control register is changed by ESD attack.
Figure 3:
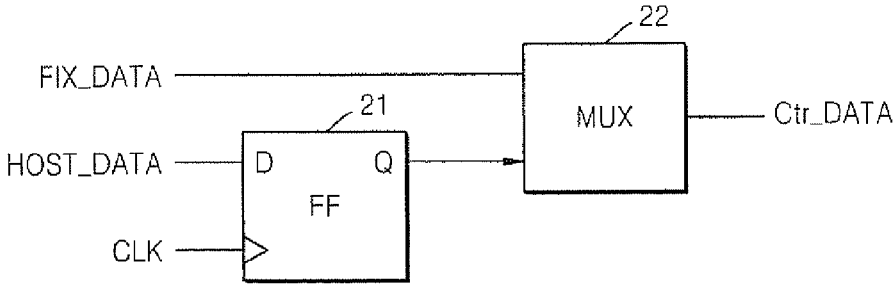
FIG. 3 (PRIOR ART)
FIG. 3 is a block diagram of a conventional logic circuit that provides fixed control data.
Figure 4:
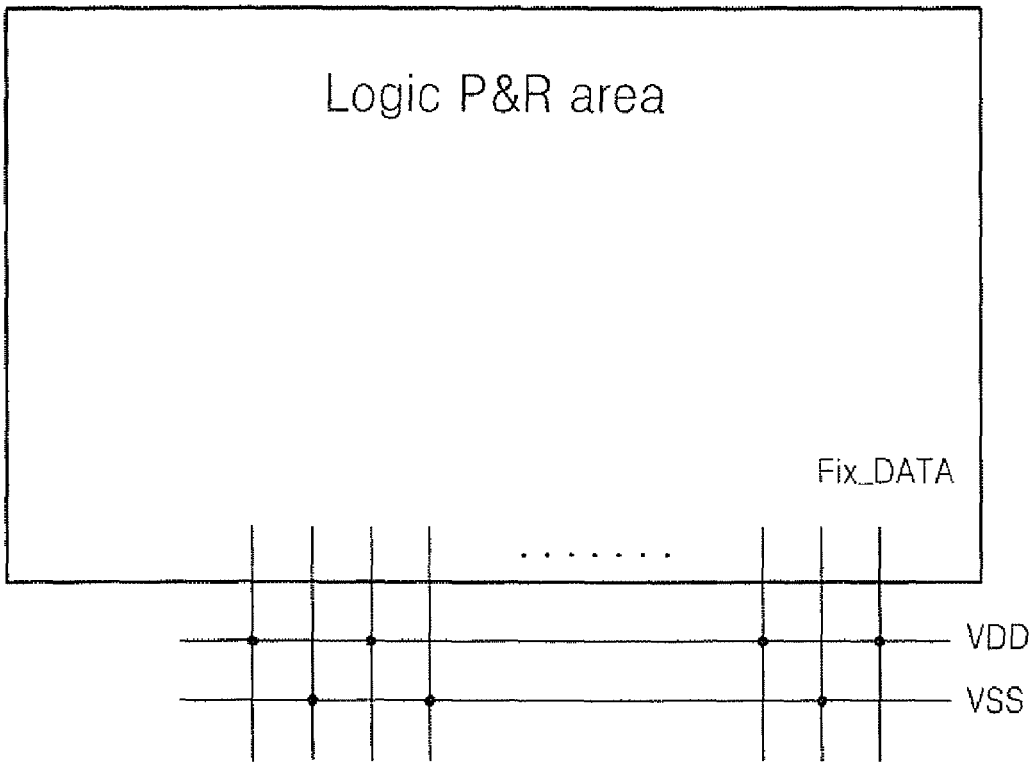
FIG. 4 (PRIOR ART)
FIG. 4 illustrates a metal layout of a display device driving circuit having the logic circuit illustrated in FIG. 3.
Figure 8:
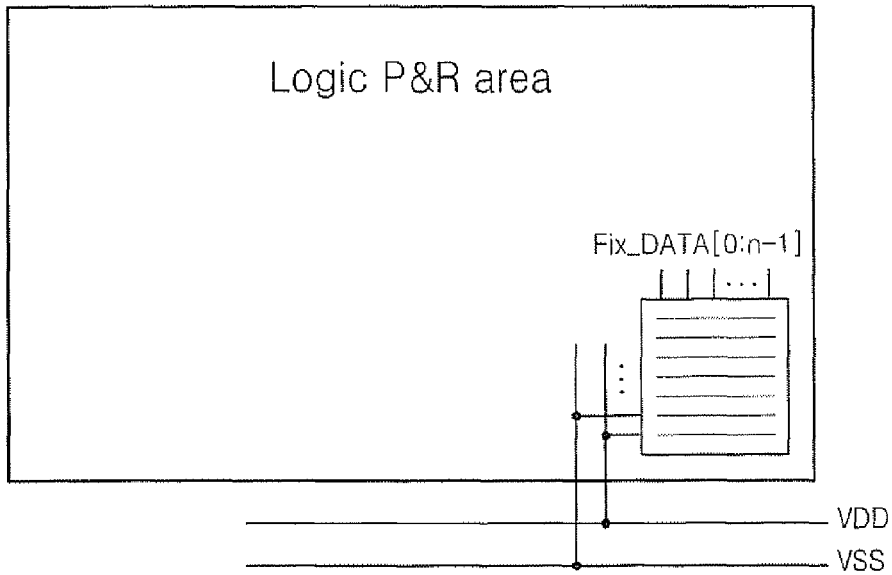
FIG. 8 illustrates a layout of a display device driving circuit according to an exemplary embodiment of the present invention.

FIG. 8 illustrates a layout of a display device driving circuit according to an exemplary embodiment of the present invention. In the conventional metal layout illustrated in FIG. 4, the same number of metal lines as the fixed control data (e.g., 1000 fixed control data), are required in order to provide the 1000 fixed control data, causing inefficiency in placing and routing. On the other hand, in the layout according to an exemplary embodiment of the present invention illustrated in FIG. 8, the number of metal lines connected to the power supply voltage VDD line or the ground voltage VSS line to provide fixed control data can be reduced, thereby making placing and routing more efficient.

Figure 9:
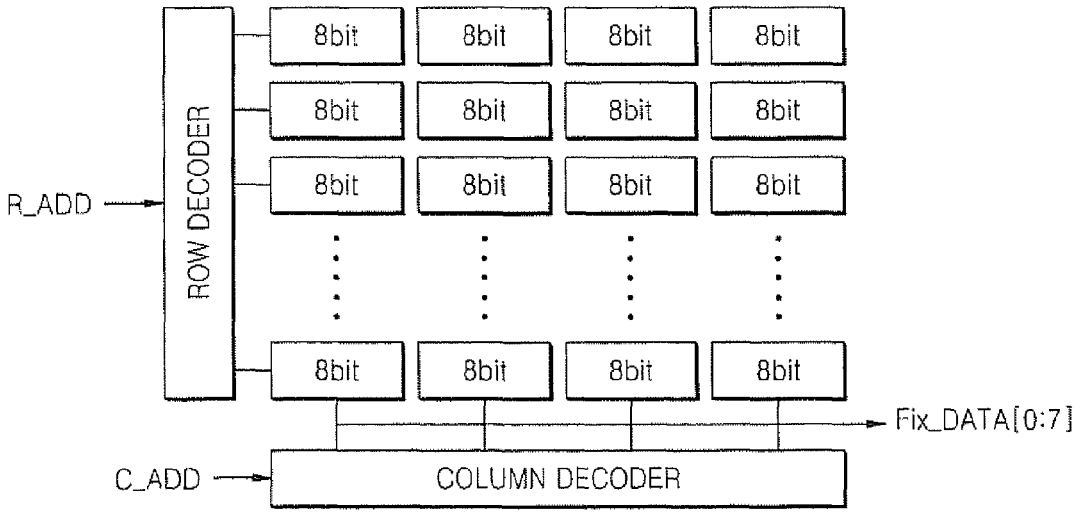
FIG. 9 is a block diagram of a portion of a display device driving circuit according to a second exemplary embodiment of the present invention.

FIG. 9 is a block diagram of a portion of a display device driving circuit according to a second exemplary embodiment of the present invention, in which a fixed control data generation of the display device driving circuit is illustrated and a bit-per-word (BPW) ratio is eight (8). The fixed control data generation unit illustrated in FIG. 9 includes a plurality of logic devices having at least one row and at least one column. Each of the logic devices is electrically connected to the power supply voltage VDD or the ground voltage VSS and outputs the power supply voltage VDD or the ground voltage VSS as fixed control data in response to a row address signal (R_ADD) output from a row decoder and a column address signal (C_ADD) output from a column decoder. When the BPW is set to 8 bits as illustrated in FIG. 9, the fixed control data generation unit outputs fixed control data Fix_DATA [0:7] of 8 bits in response to the row address signal (R_ADD) and the column address signal (C_ADD). For example, when the plurality of logic devices have 32 rows and 4 columns, the fixed control data output from the plurality of logic devices is composed of 32*4*8=1024 bits.

Figure 10:
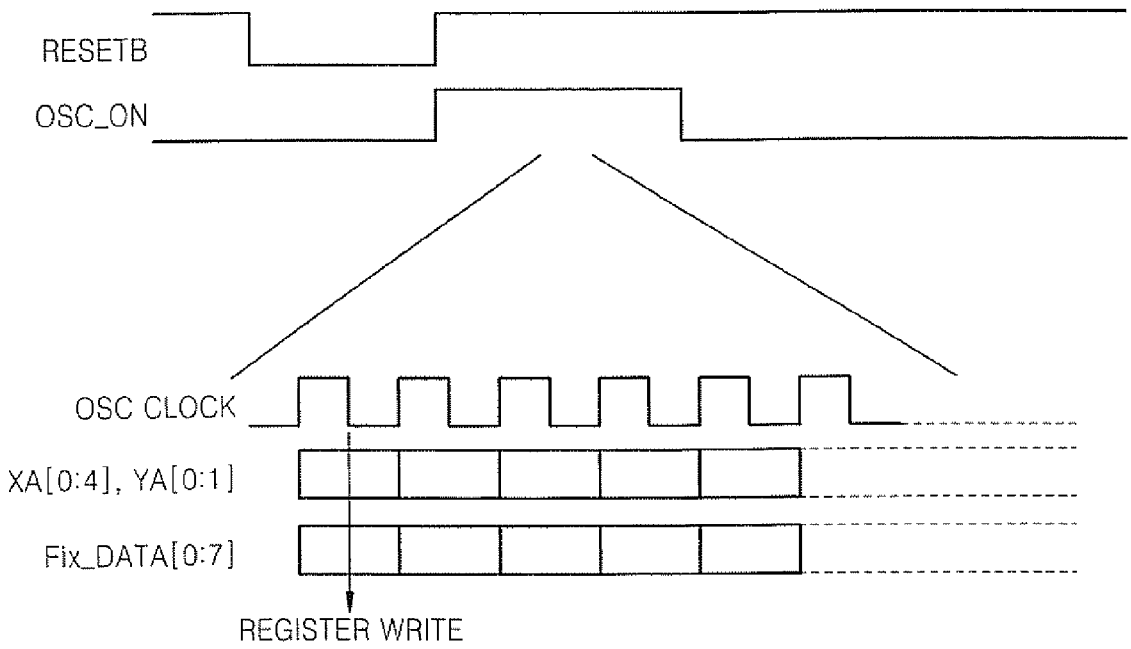
FIG. 10 is a waveform for illustrating the operation of a display device driving circuit according to an exemplary embodiment of the present invention.

FIG. 10 is a waveform for illustrating the operation of a display device driving circuit according to an exemplary embodiment of the present invention. In an initialization stage for the display device driving circuit, a predetermined reset operation is performed and a control signal OSC_ON for driving an oscillator is activated during a predetermined interval after the reset operation. Upon activation of the control signal OSC_ON, an oscillation signal OSC_CLOCK is generated from the oscillator and the timing control unit 150 illustrated in FIG. 5 generates a row address signal and a column address signal using the oscillation signal OSC_CLOCK. For example, when the plurality of logic devices have 32 rows and 4 columns, the row address signal may be composed of 5 bits XA[0:4] and the column address signal may be composed of 2 bits YA[0:1]. The generated row address signal XA[0:4] and the generated column address signal YA[0:1] are provided to the fixed control data generation unit. The plurality of logic devices included in the fixed control data generation unit sequentially output the fixed control data Fix_DATA[0:7] in units of 8 bits in response to the row address signal XA[0:4] and the column address signal YA[0:1] that are sequentially activated.

Thus, as described above, embodiments of the present invention include a display device driving circuit 100 having a control data generation unit 140 therein. This generation unit 140 is configured to generate a fixed stream of control data (Fix_DATA) in response to at least one row address (R_ADD) and at least one column address (C_ADD). According to some of these embodiments, the generation unit 140 includes a two-dimensional array of logic devices. Each of these logic devices is electrically coupled to a corresponding row line, a corresponding column line and a corresponding one of a pair of signal lines held at unequal voltage levels (e.g., logic 0 and logic 1). This pair of signal lines may include a power supply voltage line (e.g., Vdd) and a ground voltage line (e.g., Vss). According to embodiments of the invention, the logic devices within the two-dimensional array may be CMOS transmission gates (T11-T44) having a first current carrying terminal electrically connected to a corresponding column line, a second current carrying terminal electrically connected to a corresponding one of the pair of signal lines and a first control terminal electrically connected to a corresponding row line. This electrical connection between the second current carrying terminal and the corresponding one of the pair of signal lines may be provided by a fuse element (not shown).

According to further aspects of these embodiments, a row decoder 142 and a column decoder 143 are provided. The row decoder 142 may be electrically connected to the two-dimensional array of logic devices by a plurality of the row lines and the column decoder 143 may be electrically connected to the two-dimensional array of logic devices by a plurality of the column lines. These embodiments of the present invention may also include a control data selection circuit 120 configured to receive the fixed stream of control data from the generation unit 140 during a control data loading operation. The control data selection circuit includes a multiplexer 121-1 having a first input terminal electrically coupled to a serial data output of the generation unit 140. A register unit 130 may also be included. The register unit 130 is electrically coupled to an output of the control data selection circuit 120.

In the drawings and specification, there have been disclosed typical preferred embodiments of the invention and, although specific terms are employed, they are used in a generic and descriptive sense only and not for purposes of limitation, the scope of the invention being, set forth in the following claims.

What is claimed is:

1. A display device driving circuit comprising:

a fixed control data generation unit including a plurality of logic devices arranged as a two-dimensional array having a plurality of rows of logic devices and a plurality of columns of logic devices therein;

a register unit configured to store fixed control data received from said fixed control data generation unit; and a logic circuit configured to receive a signal provided from the register unit as control data and generate a signal for driving a display device by performing a logic operation using the control data;

wherein each of the plurality of logic devices is connected to one of a first voltage and a second voltage through a metal line; and wherein each of the plurality of logic devices is configured to provide a respective one of the first and second voltages, being as said fixed control data, to its respective output in response to a corresponding row address signal and a corresponding column address signal.

2. The display device driving circuit of claim 1, wherein the fixed control data generation unit comprises:

a row decoder configured to drive the plurality of rows of logic devices; and a column decoder configured to drive the plurality of columns of logic devices.

3. The display device driving circuit of claim 2, wherein the fixed control data generation unit further comprises an output control unit that is connected between the plurality of logic devices and the column decoder and controls the output of fixed control data provided from the plurality of logic devices.

4. The display device driving circuit of claim 3, wherein each of the plurality of logic devices includes a respective switching unit whose first electrode is connected to one of the first voltage and the second voltage and whose second electrode is connected to the output control unit.

5. The display device driving circuit of claim 4, wherein each of the switching units controls transmission of a voltage connected to its first electrode to its second electrode in response to a signal output from the row decoder.

6. The display device driving circuit of claim 1, wherein the first voltage is a power supply voltage and a second voltage is a ground voltage.

7. The display device driving circuit of claim 1, further comprising a timing control unit that generates a row address signal and a column address signal for controlling the output of the fixed control data and generates a control clock signal for controlling the output of the fixed control data stored in the register unit.

8. The display device driving circuit of claim 7, further comprising a control data selection unit that is connected between the fixed control data generation unit and the register unit, receives the fixed control data and host control data that is provided from a host, and outputs one of the fixed control data and the host control data to the register unit.

9. The display device driving circuit of claim 8, wherein the control data selection unit comprises a first multiplexer that receives the fixed control data and the host control data and provides one of the fixed control data and the host control data to an input terminal of the register unit.

10. The display device driving circuit of claim 9, wherein the control data selection unit further comprises a second multiplexer that receives the control clock signal and a host clock signal that is provided from the host and provides one of the control clock signal and the host clock signal to a clock terminal of the register unit.

11. The display device driving circuit of claim 7, wherein the fixed control data generation unit outputs fixed control data of a plurality of bits corresponding to a single address.

12. The display device driving circuit of claim 1, wherein the register unit comprises a plurality of flip-flops, and each of the flip-flops receives and stores the first voltage or the second voltage as the fixed control data and outputs the stored fixed control data to the logic circuit.

13. A display device driving circuit, comprising:

a generation unit configured to output a fixed stream of control data in response to a plurality of row address signals and a plurality of column address signals, said generation unit comprising a two-dimensional array of logic devices therein, with each of the logic devices electrically coupled to a corresponding row line, a corresponding column line and a corresponding one of a pair of signal lines held at unequal voltages;

a register unit configured to store the fixed stream of control data received from said generation unit; and a logic circuit configured to drive a display device with signals generated in response to performing logic operations on the control data received from said register unit;

wherein each of the logic devices in the two-dimensional array is configured to provide one of the unequal voltages, being as said fixed stream of control data, to a corresponding column line in response to a corresponding row address signal and a corresponding column address signal.

14. The driving circuit of claim 13, wherein each of the logic devices comprises a transmission gate; and wherein each of the transmission gates has an input terminal connected to a corresponding one of the pair of signal lines held at unequal voltages, an output terminal connected to a corresponding column line and a control terminal connected to a corresponding row line.

* * * * *